United States Patent [19]

Pearlman et al.

[11] Patent Number: 4,733,138

[45] Date of Patent: Mar. 22, 1988

[54] PROGRAMMABLE MULTICIRCUIT WALL-MOUNTED CONTROLLER

[75] Inventors: Gordon W. Pearlman; Steven B. Carlson, both of Portland, Oreg.

[73] Assignee: Lightolier Incorporated, Jersey City, N.J.

[21] Appl. No.: 937,893

[22] Filed: Dec. 4, 1986

Related U.S. Application Data

[63] Continuation-in-part of Ser. No. 804,827, Dec. 5, 1985, abandoned.

[51] Int. Cl.[4] ..... H05B 37/02

[52] U.S. Cl. ..... 315/307; 315/194; 315/293; 315/316; 315/DIG. 4

[58] Field of Search ..... 315/307, DIG. 4, 292, 315/293, 194

[56] References Cited

U.S. PATENT DOCUMENTS 4,095,139 6/1978 Symonos ..... 315/293
4,253,048 2/1981 Osaka ..... 315/293
4,359,670 11/1982 Hosaka et al. ..... 315/293
4,649,323 3/1987 Pearlman ..... 315/362

*Primary Examiner*—Harold Dixon
*Attorney, Agent, or Firm*—Chernoff, Vilhauer, McClung & Stenzel

[57] ABSTRACT

A programmable lighting circuit controller for controlling a plurality of household lighting circuits includes a microprocessor and an electronically erasable programmable read only memory for programming the household lighting circuits for a variety of loads. The lighting circuits may be configured as a combination of incandescent and fluorescent loads by designating one output of the controller as a heater circuit for any of the fluorescent loads. The microprocessor is controlled by a set of nonlatching pushbuttons on a front panel which raise and lower lighting levels, set lighting levels in memory and recall preset levels from memory. Combination of two pushbuttons simultaneously pushed may initiate special programming features such as heater designation of one channel for fluorescent lighting.

9 Claims, 14 Drawing Figures

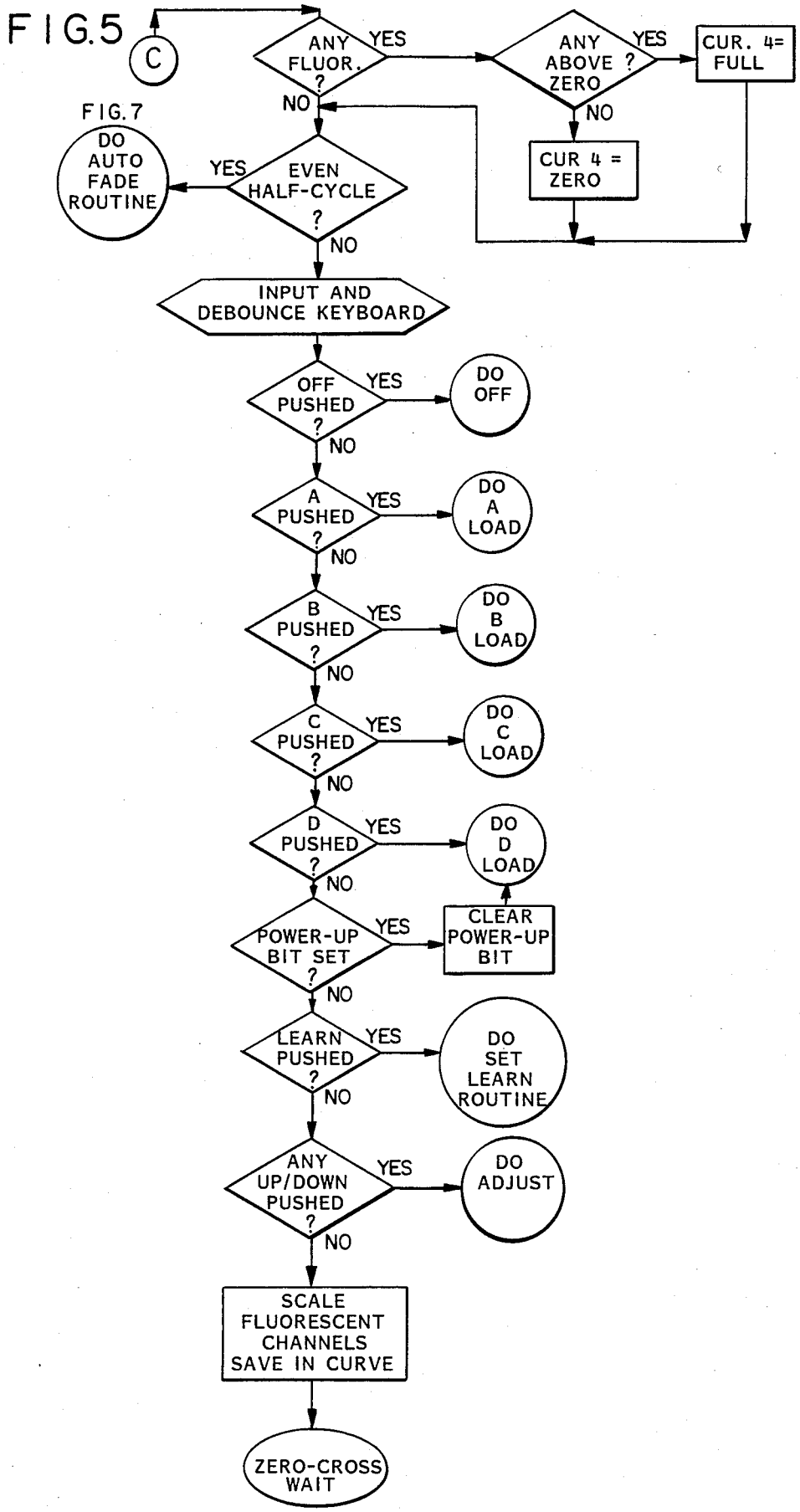
FIG.5
C
ANY FLUOR. ?
YES
NO
ANY ABOVE ZERO ?
YES
NO
CUR. 4= FULL
CUR 4 = ZERO
FIG.7
DO AUTO FADE ROUTINE
YES
EVEN HALF-CYCLE ?
NO
INPUT AND DEBOUNCE KEYBOARD
OFF PUSHED ?
DO OFF
A PUSHED ?
DO A LOAD
B PUSHED ?
DO B LOAD
C PUSHED ?
DO C LOAD
D PUSHED ?
DO D LOAD
POWER-UP BIT SET ?
CLEAR POWER-UP BIT
LEARN PUSHED ?
DO SET LEARN ROUTINE
ANY UP/DOWN PUSHED ?
DO ADJUST
SCALE FLUORESCENT CHANNELS SAVE IN CURVE
ZERO-CROSS WAIT

AUTO FADE ROUTINE
FADER = FULL ?
YES
NO
ZERO-CROSS WAIT

INC FADER START W/ CHANNEL 1
DIF = NEW - OLD
DIF NEGATIVE ?
YES
NO
CUR = OLD+(DIF*FADER)
CUR = OLD-(DIF*FADER)
DONE FIRST 3 CHANNELS
NO
YES

DONE ALL 4 CHANNELS ?
YES
NO
ZERO-CROSS WAIT
ANY FLUOR. ?
YES
NO
ANY ABOVE ZERO ?
YES
NO
NON-DIM ?
NO
YES
CUR 4 = ZERO
CUR 4 = FULL
FADER = ZERO ?
YES
NO
ZERO-CROSS WAIT
NEW = ZERO ?
YES
NO

FIG. 8
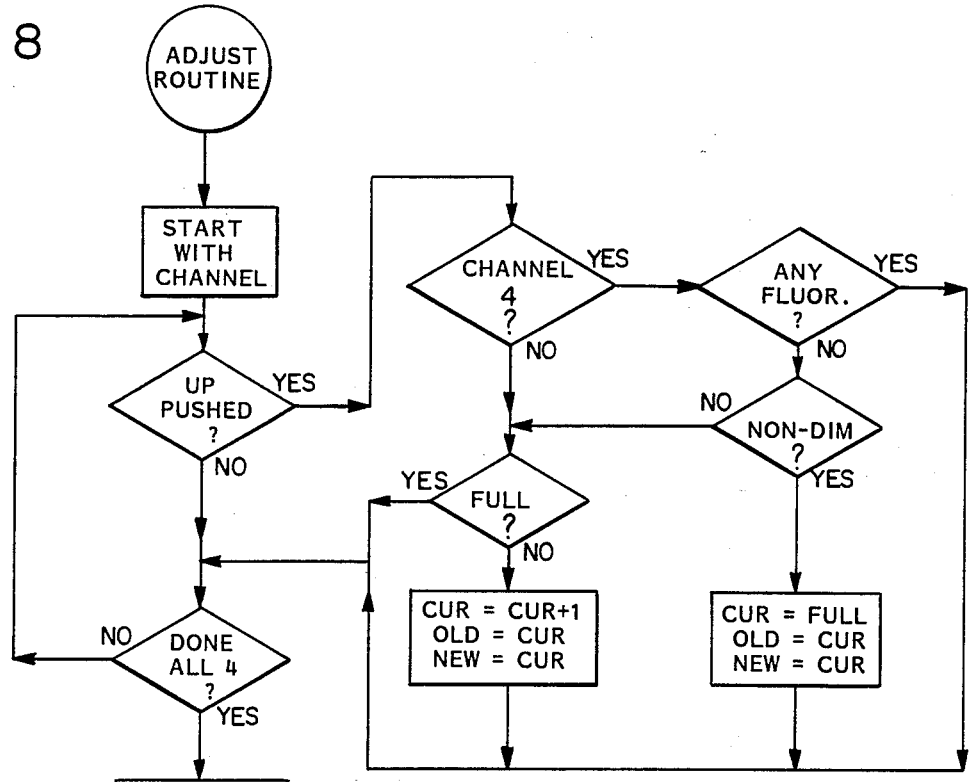
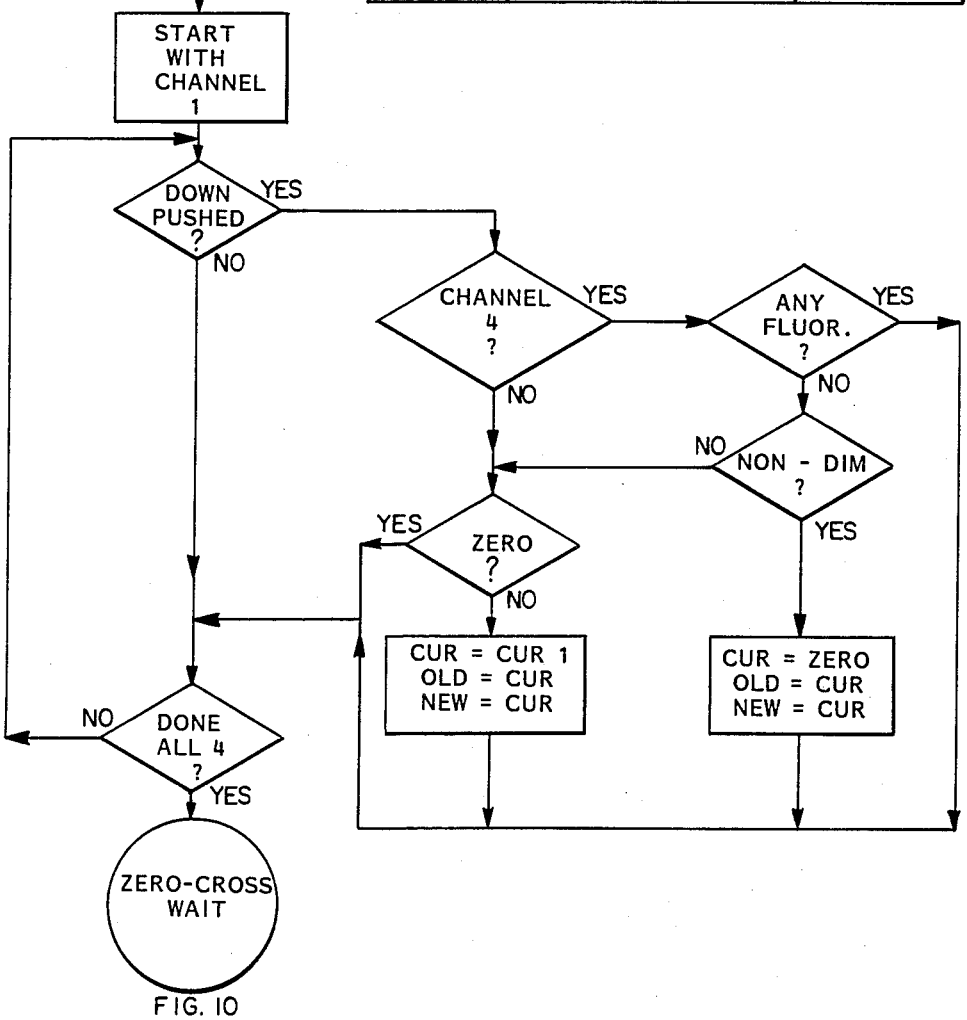
FIG. 10

FIG. 9
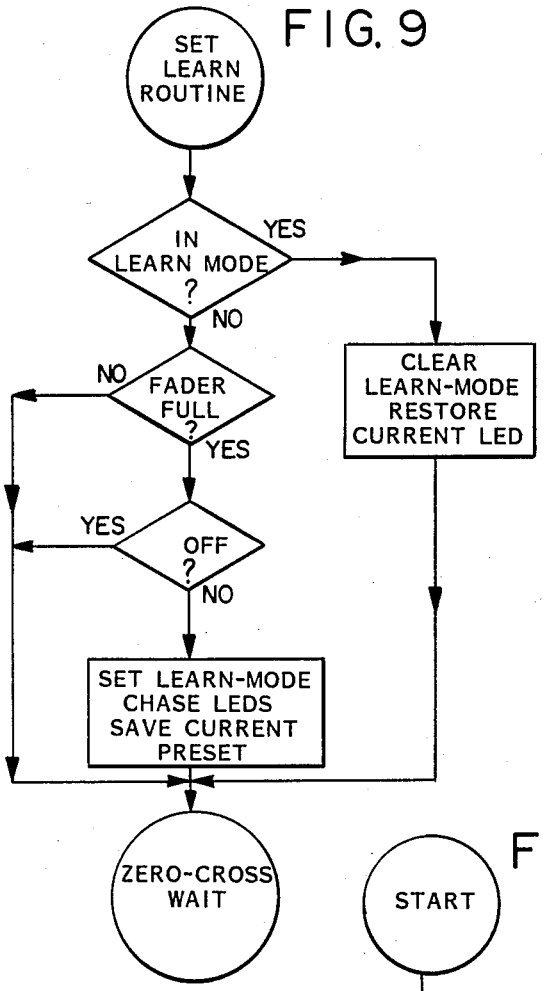
FIG. 10
FIG. 10
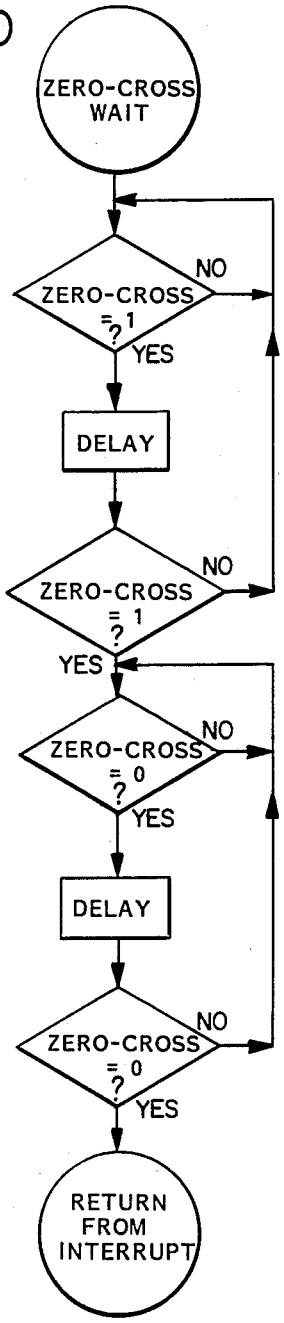
FIG. 12
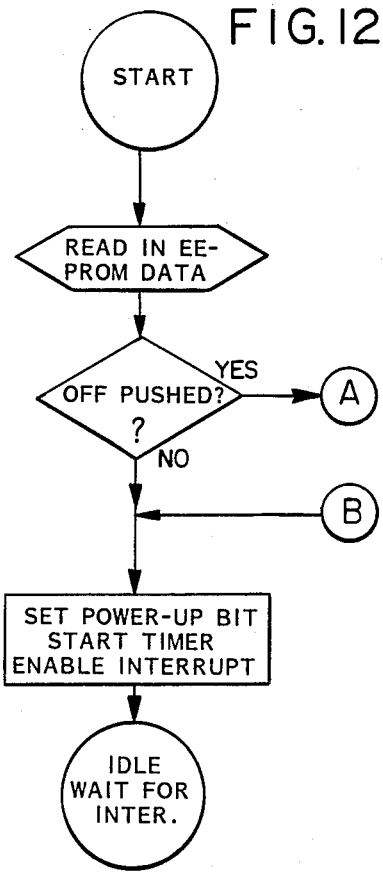

+5V
Q5
PN2907A
R12
10K
R11
1K
IPWR
R10
180
COM
U1
MOC3021
U2
MOC3021
U3
MOC3021
U4
MOC3021
R1
180
R2
1.2K
R3
180
R4
1.2K
R5
180
R6
1.2K
R7
180
R8
1.2K
C1
0.1uF
C2
0.1uF
C3
0.1uF
C4
0.1uF
Q1
10AMP
Q2
10AMP
Q3
10AMP
Q4
10AMP
J1
LOAD WIRE
J2
LOAD WIRE
J3
LOAD WIRE
J4
LOAD WIRE
LINE
U5
75498
A1
A2
A3
A4
A5
A6
A7
A8
A9
Y1
Y2
Y3
Y4
Y5
Y6
Y7
Y8
Y9
U6
NMC9306
DI
CS
SK
DO
J8
8181/12
DS1
GREEN
DS2
GREEN
DS3
GREEN
DS4
GREEN
DS5
RED
R9
330 OHM
COM
+5V

PROGRAMMABLE MULTICIRCUIT WALL-MOUNTED CONTROLLER

This application is a continuation-in-part of our co-pending patent application Ser. No. 804,827 filed Dec. 5, 1985 now abandoned.

BACKGROUND OF THE INVENTION

The present invention relates to a wall-mounted switch box for controlling a plurality of household AC lighting circuits and more particularly to a system of lighting circuits in which one or more of the circuits may include fluorescent lighting.

Typical household wiring usually includes a panel of lighting switches located in a hallway or foyer for controlling a plurality of lighting circuits in the hallway and in adjoining rooms. Sometimes dimmers are included along with the light switches for controlling the level of power supplied to each one of the lighting circuits. These dimmers usually take the form of reostats which are manually set to the desired level of brightness.

A single line programmable dimmer for one of such circuits is shown in our co-pending application Ser. No. 724,015 now U.S. Pat. No. 4,649,323 issued Mar. 10, 1987 entitled MICROCOMPUTER-CONTROLLED LIGHT SWITCH. That application describes a programmable dimmer actuated by a pair of single pole, single throw switches. This device is capable of operating a single load containing an incandescent light. It is not suitable for operating a fluorescent light because a fluorescent light requires an additional input to operate a heater. Moreover, ordinary dimmer switches cannot be connected to fluorescent lights because of the ballast requirements for the heater circuits.

SUMMARY OF THE INVENTION

The present invention provides a multigang wall-mounted lighting circuit controller which may be programmed to operate a plurality of lighting circuits some of which may include fluorescent lighting.

According to the preferred embodiment, four lighting circuits may be controlled and there may be as many as four preset brightness levels for the four lighting circuits. The presets may be entered into memory and erased from memory by the use of a learn mode which is initiated from the front panel of the controller by depressing a "learn" pushbutton. Apart from the presets, the four individual circuits may be controlled by dimmer switches comprising a pair of non-latching pushbuttons. One such switch is designated an "up" switch and the other is designated a "down" switch so that pressing the up switch raises the level of brightness and conversely pressing the down switch lowers the level of brightness.

The controller includes a microprocessor and an erasable programmable read only memory. Each of the front panel switches provides an input to the microprocessor which is programmed to sense the closing of the contacts of each of the switches and provide the function that is called for by the closing of the particular switch. There are four load line outputs which may under normal conditions be connected to four incandescent lighting circuits. However, if desired, one of the circuits, channel 4, may be connected to the heating circuits of one or more fluorescent lighting fixtures on channels 1, 2 or 3. The microprocessor may be programmed to designate channel 4 as a heater circuit upon the depression of certain predetermined switches on the front panel. In this configuration the 4th channel provides power to the heating circuits of one or more fluorescent lights depending upon whether those fluorescent lights are on or off. Thus this channel will no longer function in a dimmer mode but will only supply power to the circuits containing the fluorescent lights of those circuits that are activated.

It is a primary object of this invention to provide a multigang wall-mounted programmable light circuit controller capable of assuming differing configurations depending upon whether incandescent or fluorescent lighting is to be utilized.

A further object of this invention is to provide a multichannel programmable dimmer in which various combinations of lighting levels may be stored in memory and may be instantly recalled from memory by depressing a front panel switch.

A still further object of this invention is to provide a multichannel lighting circuit controller under the control of a microprocessor which is responsive to the closing of contacts of a plurality of non-latching single pole, single throw switches for initiating various control functions.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIGS. 3–10 are flow chart diagrams depicting the programming of the microprocessor shown in FIG. 2 for fluorescent and incandescent lighting circuit configurations.

FIGS. 12 and 13 are flow chart diagrams further explaining the programming of the microprocessor shown in FIG. 2.

DETAILED DESCRIPTION OF THE INVENTION

Figure 1:
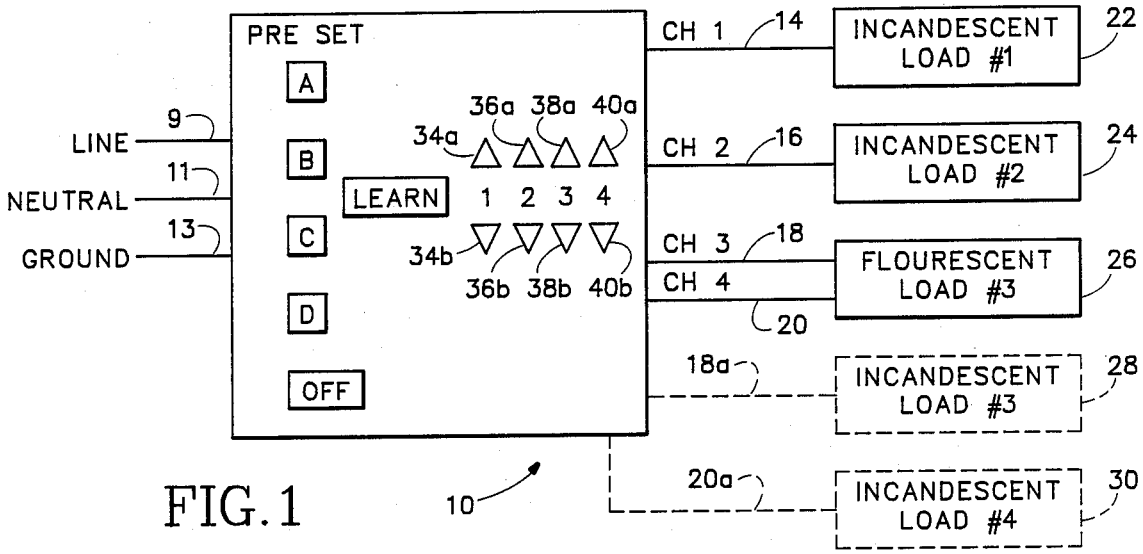
FIG. 1 is a block schematic diagram of a multichannel function controller showing the layout of the front panel of the controller.

A multichannel light circuit controller 10 includes a front panel 12 which is connected to the household wiring which consists of a line wire 9, a neutral wire 11 and a ground wire 13. The controller is physically incorporated behind the front panel and includes four outputs on output lines 14, 16, 18 and 20, respectively. Shown in dotted outline are alternate configurations for the output lines 18*a* and 20*a*. Line 14 drives an incandescent load 22, line 16 drives an incandescent load 24, and lines 18 and 20, respectively, drive a fluorescent load 26. In the alternative, lines 18 and 20, respectively, could drive two other incandescent loads indicated as incandescent load number 3 at block 28 and incandescent load number 4, block 30. In yet another configuration (not shown) the loads at blocks 22 and 24 could both be fluorescent loads and line 20 would then be connected in parallel to the heater circuits of both fluorescent lights. That is, channel 4 may drive the heater circuits of as many fluorescent lights as are connected to the controller 10. The four circuits are shown by way of illustration only, it being understood that, depending upon the microprocessor employed, any number of external circuits could be controlled.

The front panel 12 includes 4 pre-set switches labeled A, B, C and D. There is also an "off" switch and a "learn" switch. All of these switches are single-pole, single-throw non-latching pushbuttons. The depression of each of the switches grounds a voltage available from a local power supply and provides the microprocessor with a logical "zero" input. The microprocessor recognizes the logical zero as a signal that the switch has been depressed. Other configurations of the switches are possible, it being important only that the switch have an operative and a non-operative position in order to provide logic signals to the microprocessor. Each channel includes a pair of "up" and "down" switches labeled as 1, 2, 3 and 4 on front panel 12. Channel 1 includes up button 34A and down button 34B; channel 2 includes up button 36A and down button 36B; channel 3 includes up button 38A and down button 38B; and channel 4 includes up button 40A and down button 40B.

Figure 2:
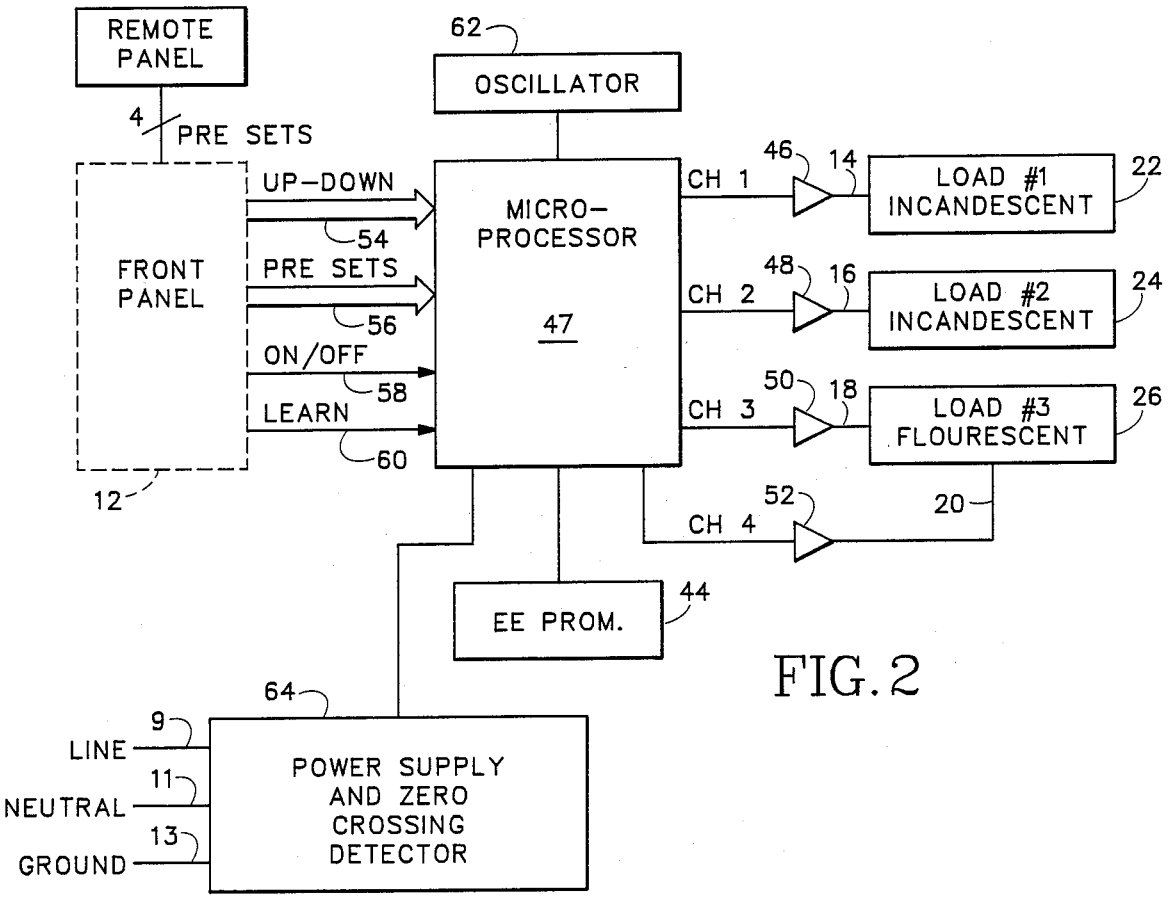
FIG. 2 is a block schematic diagram of the function controller of FIG. 1.

Referring now to FIG. 2, the controller 10 includes a microprocessor 42 and an electrically erasable programmable read only memory (EEPROM) 44. Each of the line outputs 14, 16, 18 and 20 include buffer amplifiers 46, 48, 50 and 52. The front panel 12 is connected to the microprocessor 42 via a series of busses. The up-down switches for channels one through four are connected to 8 inputs of microprocessor 42 on bus 54. The preset lines are connected to four inputs of microprocessor 42 on bus 56. The off switch is connected on line 58 and the learn switch is connected on line 60. An oscillator 62 provides internal timing for the microprocessor 42.

The microprocessor 42 provides firing commands to thyristors (not shown) which are included in each of the load circuits 22, 24 and 26. The manner of operation of such circuits is well-known in the art and is described in more detail in the aforementioned copending application Ser. No. 724,015. In order to synchronize the firing commands for the aforementioned loads a power supply and zero crossing detector 64 is provided. The line voltage and the neutral line are connected to each of the loads 22, 24 and 26 and the firing commands from the microprocessor 42 close a thyristor which makes the line voltage available to the load for a chosen portion of each half cycle of the alternating current wave form, corresponding to the degree of brightness desired. In channel 4, if configurated as a heater circuit, the thyristor is maintained in a closed condition whenever the load of channel 3 is turned on regardless of what the brightness setting might be. This is because the power requirements for the heater circuits are constant.

Figure 13:
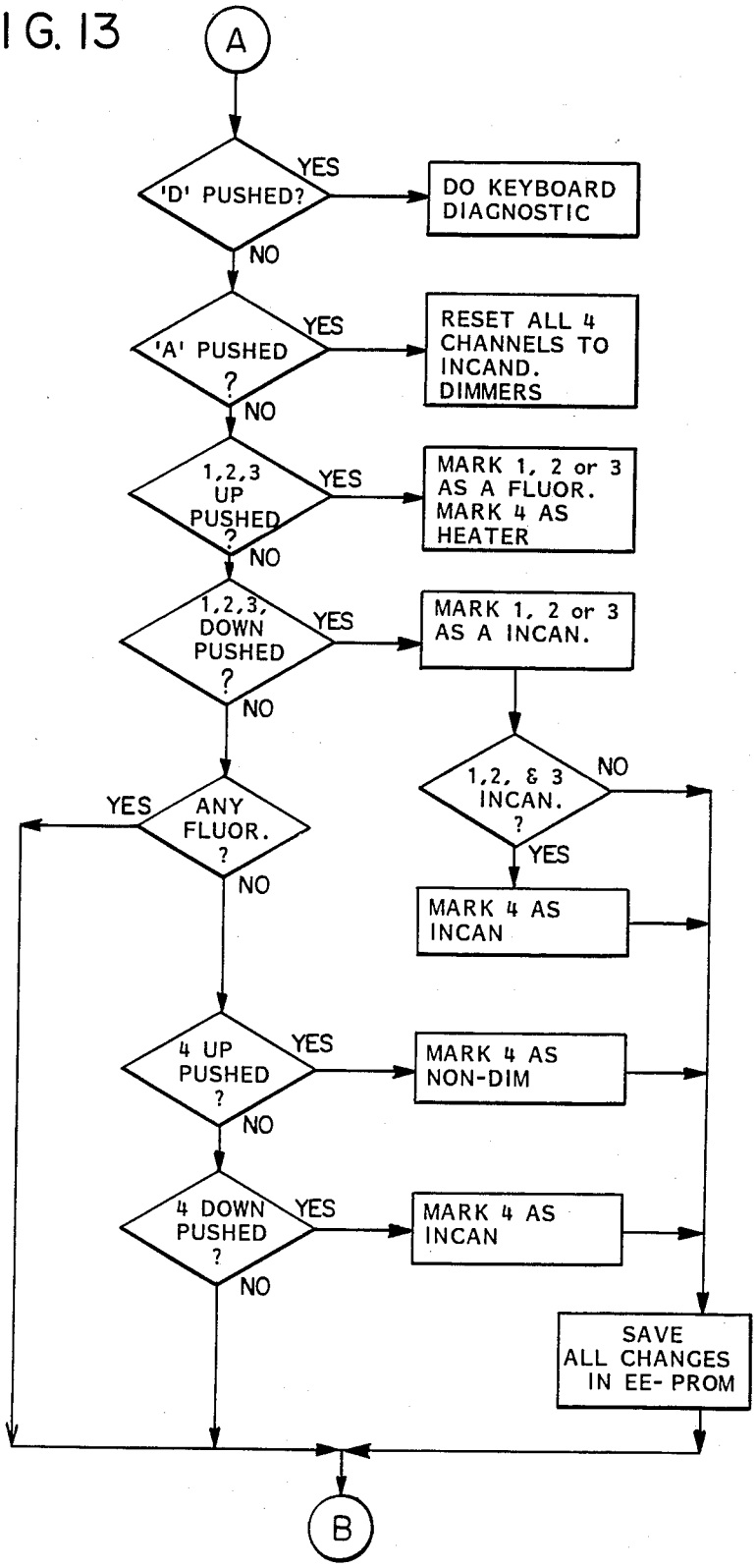

Referring now to FIGS. 12 and 13, upon power up of the unit data is read in from the EEPROM 44. If the off button on the front panel 12 is pushed in conjunction with certain other pushbuttons, the microprocessor 42 is placed in a special mode which enables it to reprogram the external channels for fluorescent loads or to program channel 4 as a non-dim channel. A non-dim channel, that is, one that is either full-off or full-on but which is never operated at less than full power, is useful when running an appliance such as a projector, a television and the like. Thus, if the off button is pushed upon power up and the D pre-set button is also pushed, the microprocessor 42 performs a keyboard diagnostic to determine if the front panel 12 is fully operational. The details of such a test program are well-known to those skilled in the art of microprocessor programming. If the A preset button is pushed while the off button is pushed, all four channels are reset as incandescent dimmers. This information is saved in the EEPROM if it represents a change from the last existing condition. If, instead of the A or D preset the 1, 2 or 3 up buttons 34A, 36A or 38A are pushed, these channels are marked as fluorescent lighting circuits and channel 4 is marked as a heater. From this point, channel 4 will not function in a dimmer mode but will only either be full-off or full-on depending upon whether the fluorescent lighting circuits to which it is connected are turned on. If a change is to be made designating either channel 1, 2 or 3 as an incandescent lighting circuit (in the event that it may have previously been a fluorescent lighting circuit), the appropriate down buttons of channels 1, 2 or 3 are pushed, that is, buttons 34B, 36B and 38B. If all of channels 1, 2 and 3 are to be incandescent, channel 4 is automatically marked as an incandescent channel. If no fluorescent lighting circuits are designated and the up button for channel 4, button 40A is pushed, channel 4 is marked as a non-dim lighting circuit. If the channel 4 down button 40B is pushed, channel 4 is marked as an incandescent circuit. These designations are then written into the EEPROM by means of a digital code generated by microprocessor 42 and will remain as a part of the operating program for the microprocessor 42 until a subsequent change. After this programming has been accomplished, the microprocessor automatically sets a power up bit and starts a timer to enable a timer interrupt program to begin running. The microprocessor 42 then idles to wait for the timer interrupt.

The timer interrupt program is a conventional program to fire the thyristor for each of the four channels at a predetermined phase angle. This program may run, for example, 140 times each ½ cycle of the 60-cycle AC power input waveform. The manner in which such a program is constructed is well known in the art and may be found, for example, in the aforementioned co-pending application No. 724,015.

In actual operation the controller 10 is programmed for differing lighting levels by first adjusting the levels of brightness by utilizing the up-down switches for channels 1, 2, 3 and 4 on front panel 12. Then when the desired levels have been established they may be stored in memory by pressing the appropriate preset button along with the learn button. As many as four different pre-sets may thus be stored in the EEPROM 44. To recall a preset lighting level from memory, it is necessary only to press one of the preset buttons A, B, C or D. To adjust lighting levels on any of the four channels at any time it is necessary only to press either the up or down button for each of the channels 1 through 4. Pressing the off button alone will cause all of the lighting levels to drop to zero.

As part of its internal programming, the microprocessor periodically interrogates the front panel 12 to determine the position of the various pushbuttons. If any of the up or down buttons for channels 1–4 are depressed, the microprocessor will alter the amount of power provided to that channel in increments as long a the particular button is depressed. That is, each time the front panel is interrogated the microprocessor will incrementally increase or decrease the power to a channel depending upon which buttons are depressed. If at any time the learn button is depressed while the front panel 12 is interrogated, the current power levels will be saved in memory. Thereafter, whenever one of the preset A, B, C or D buttons is pressed the microprocessor will extract the learned power level from memory and set that level on the particular channel. Methods of programming microprocessors to provide the above-described functions are well within the ordinary skill in this art.

Figure 3:
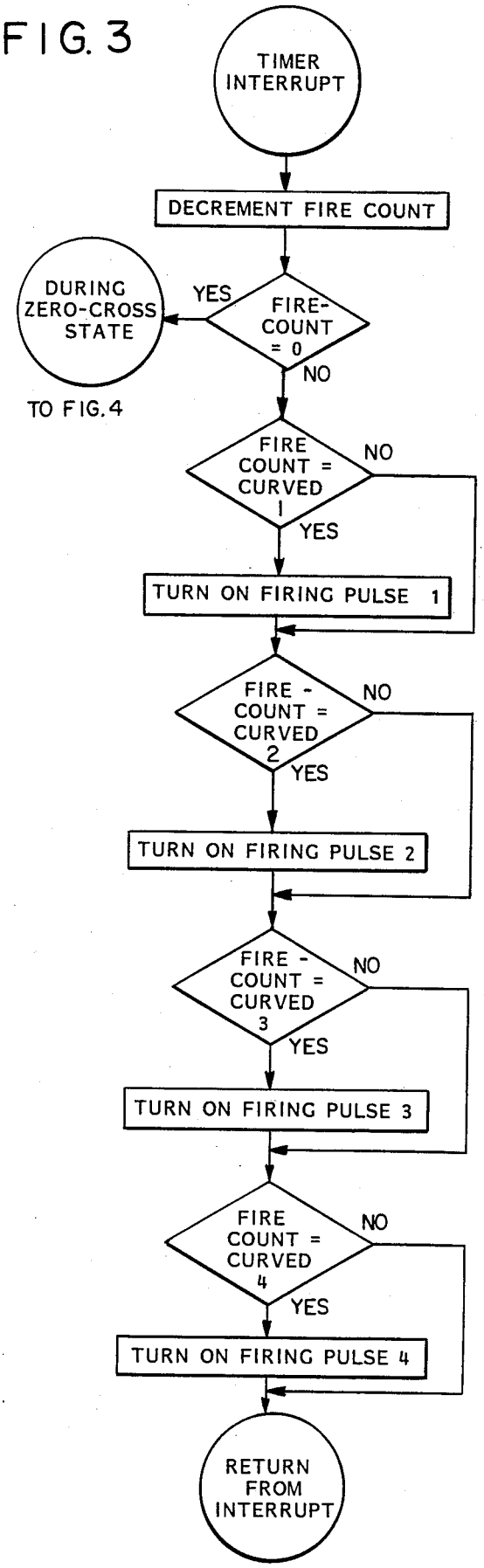
Figure 4:
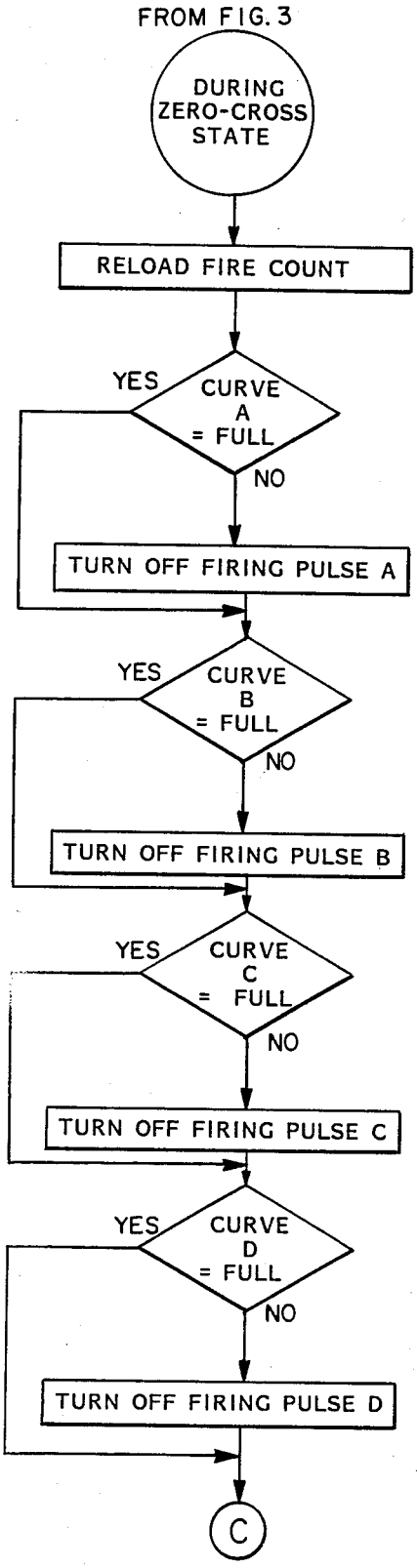

To provide a more detailed description of how the microprocessor 47 is programmed, reference may be had first, to FIG. 3 which shows a "timer interrupt" routine. This routine occurs 200 times per half cycle. Each time it runs, the "firecount" is decremented by one. When the firecount equals zero, the half cycle is over and the program brances to the "during zero cross state" routine which is shown in FIG. 4. If the firecount is not equal to zero, the microprocessor 47 asks whether the firecount is equal to the "curved data" (a variable which represents a desired lighting level) for that channel and, if it is, then sets the appropriate bit to fire that channel's triac. If the firecount is not equal to the curved data for that channel, the firing pulse is not turned on. After performing this routine the microprocessor 47 returns to the idle state to wait for the next timer interrupt.

Figure 6:
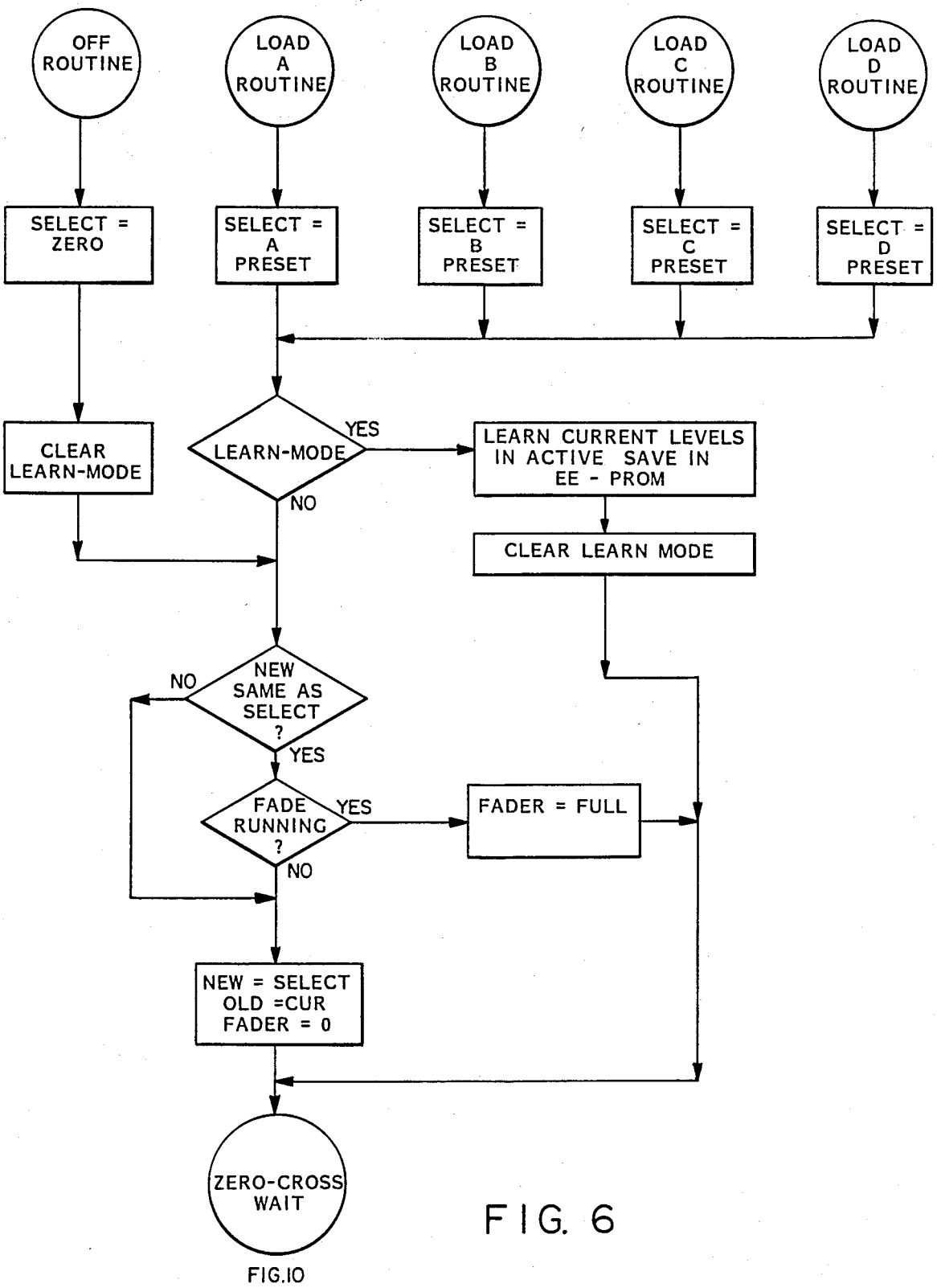

The zero crossing routine is shown in FIG. 4. At every zero crossing the firecount is reloaded to equal 200. This is an arbitrary division of each half cycle into 200 equal time increments. Next, each channel determines if it is at full output level and, if so, the appropriate firing bit is not reset. After performing this routine, the program branches to letter "C" which is shown in FIG. 5. At "C" the microprocessor first determines if any of the channels have been marked as fluorescent and are above the level of zero. If so, channel 4 is turned on full power. If none are above zero, channel 4 is turned off. On even half cycles the program branches to an auto fade routine shown in FIG. 7. On odd half cycles the routine is not performed. Next, the keyboard is checked to determine what switches may have been pushed. Associated with each of the switches is a routine, each of which is shown in FIG. 6. If the unit has just been turned on on the first time through the loop the power up bit is cleared and the "D" preset routine is performed. Next is is determined whether the "learn" button has been pushed, and if so, the learn routine is performed. This routine is shown in FIG. 9. Next, if any "up" or "down" button is pushed, an adjustment routine as shown in FIG. 8 is performed. Next, a bottom offset is added to the level stored in "current" for each channel marked as a fluorescent and is saved as part of the "curved data" for each channel.

The "off" and "load" routines are shown in FIG. 6. For each of these routines it is first determined whether the "learn" button has been pushed. If so, the current lighting levels are saved in a nonvolatile memory. Next, the learn mode is cleared. If the controller is not in the learn mode, it is determined if the selected preset in each channel is the same as the preset loaded as the last value. Moreover, if the fade routine is still in progress then it is instantly finished. If the fade is not running, new levels are established which correspond to the presets. The old levels are made the same as the current levels and the fader variable is set equal to zero. The program then returns to the zero crossing routine. (See FIG. 10)

Figures 7, 10:
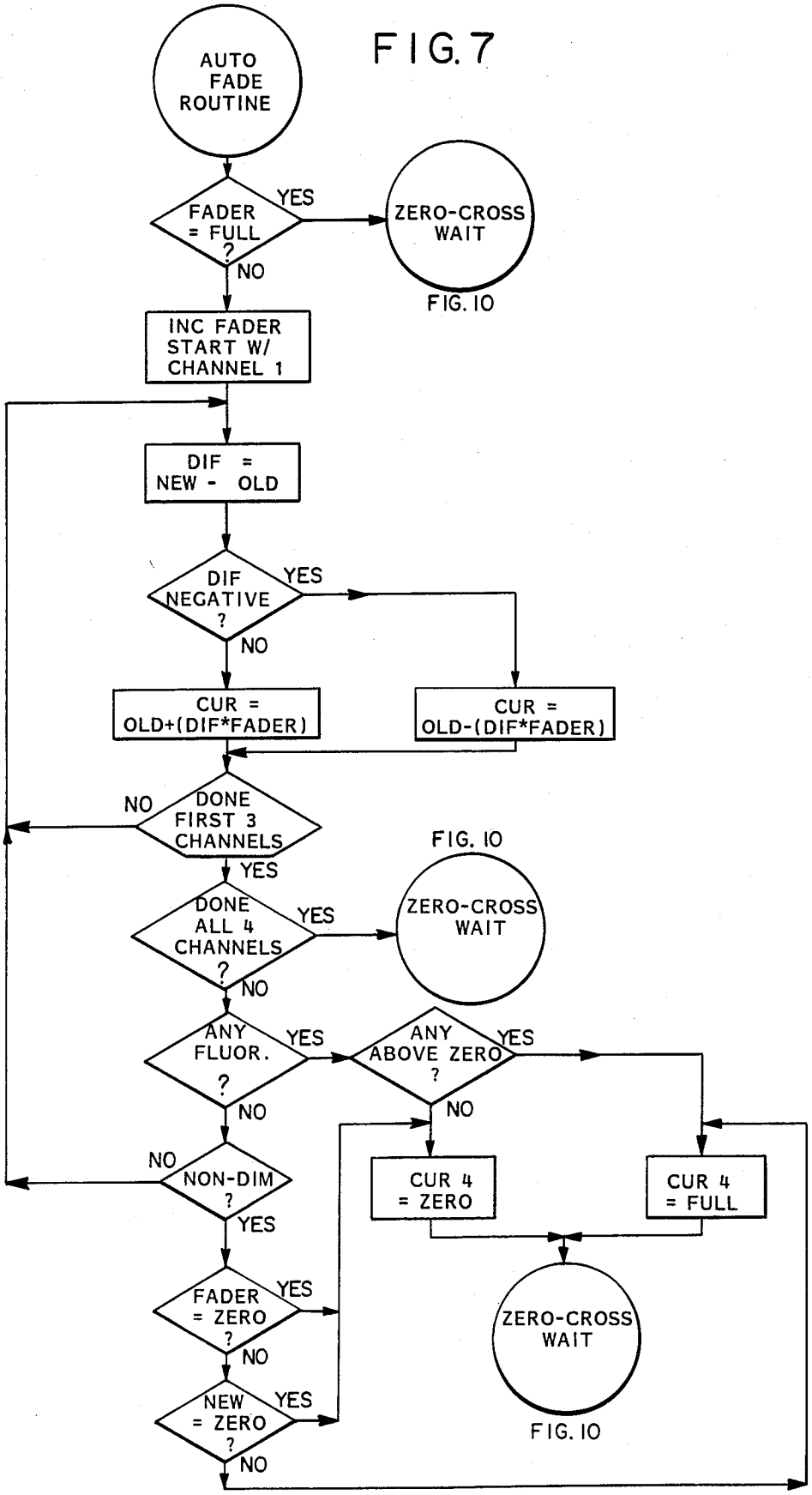

FIG. 7 shows the auto fade routine. If the fader variable is full, the auto fade routine is bypassed, and the program returns to "zero cross wait." If the fader is not full, it is incremented by one and a routine is performed for all four channels starting with channel 1. In this routine the local variable "DIF" equals the new level for each channel minus the old level for each channel. When the old level is subtracted from the new level, a determination is made as to whether DIF is negative or positive. If DIF is a negative number, the current level is faded toward zero by making it equal to the old level minus the difference times the value of the fader. If DIF is not negative the product of DIF times the fader is added to the old level. When all four channels have been calculated, the program branches to "zero cross wait." If any of the first three channels are marked as a fluorescent channel, channel 4 is set to full if any of the fluorescent channels are above zero. Otherwise, it is set to zero. Further, if channel 4 is marked as a non-dim channel and its new level is above zero, then it is set to full whenever "fader" is above zero.

The adjustment routine is shown in FIG. 8. The push-buttons are interrogated for each channel and if "up" is pushed for any channel, the variables current, old and new are raised by one unless they are already at full. If there are any channels marked as fluorescent, the channel 4 "up" button is ignored. If channel 4 is marked as a non-dim channel it is set to "full" whenever its "up" button is pushed. If "down" is pushed for any channel, the appropriate variables, current, old and new are lowered by one unless they are already at zero, and if there are any channels marked as fluorescent, the channel 4 "down" button is ignored. If channel 4 is marked as a non-dim, it is set to zero whenever its "down" button is pushed.

The learn routine is shown in FIG. 9. When the "learn" button is pushed the current learn mode is cleared and the current LEDs are turned on. If the learn button is not pushed and the fader is not running, the learn mode is set and the preset LEDs are turned on.

The "zero cross wait" routine shown in FIG. 10 checks to see if the zero cross input bit is a 1. After a delay the bit is checked again to make sure that the "1" was not noise. When the bit changes to zero, the zero crossing has occurred and after a brief delay it is checked again to make sure that the zero bit was not noise. This ensures that zero crossing has occured after which the microprocessor is returned to the idle mode to wait for the next timer interrupt.

Figure 11A:
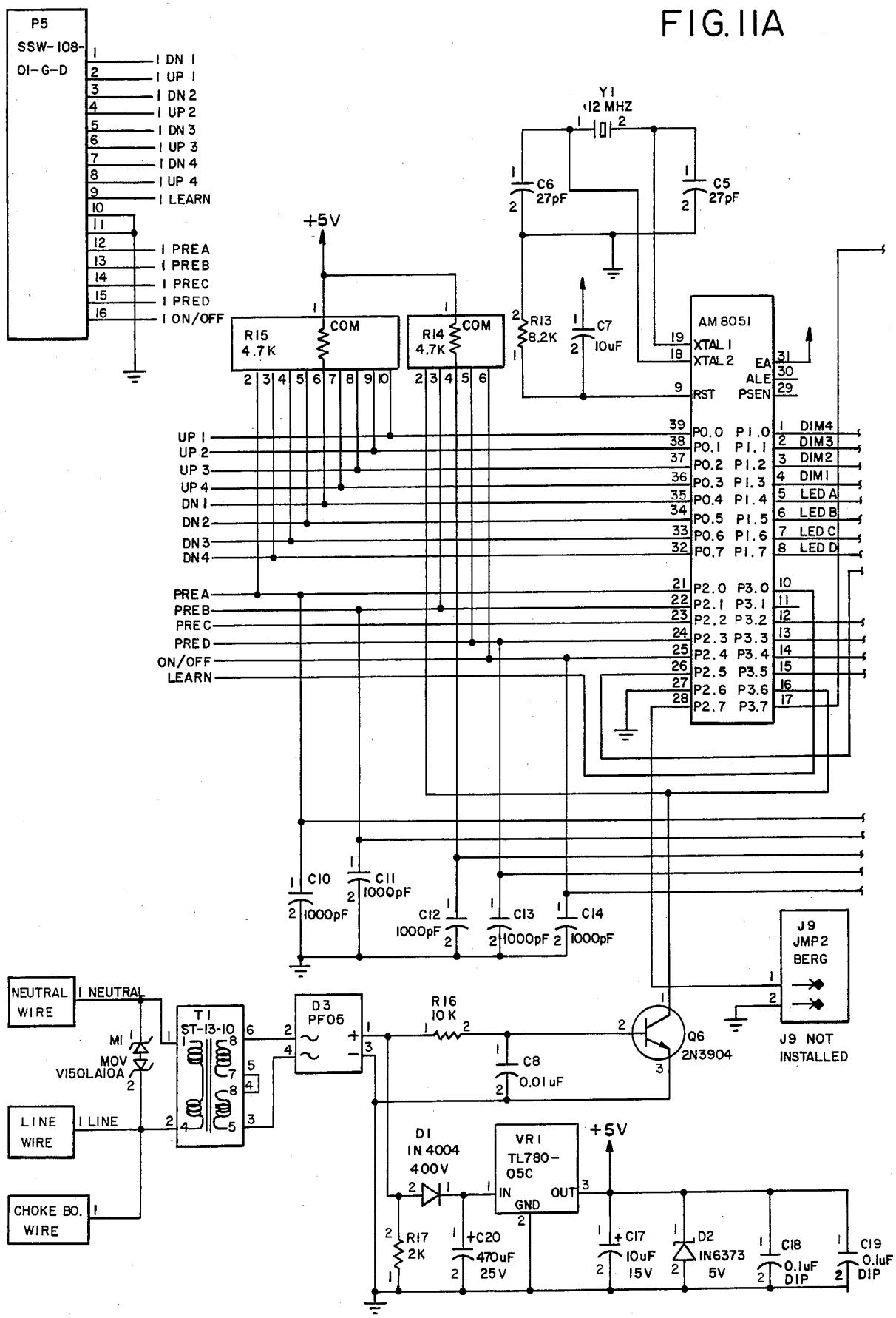
FIGS. 11*a* and 11*b* comprise an expanded detailed schematic diagram of the block schematic diagram of FIG. 2.
Figure 11B:
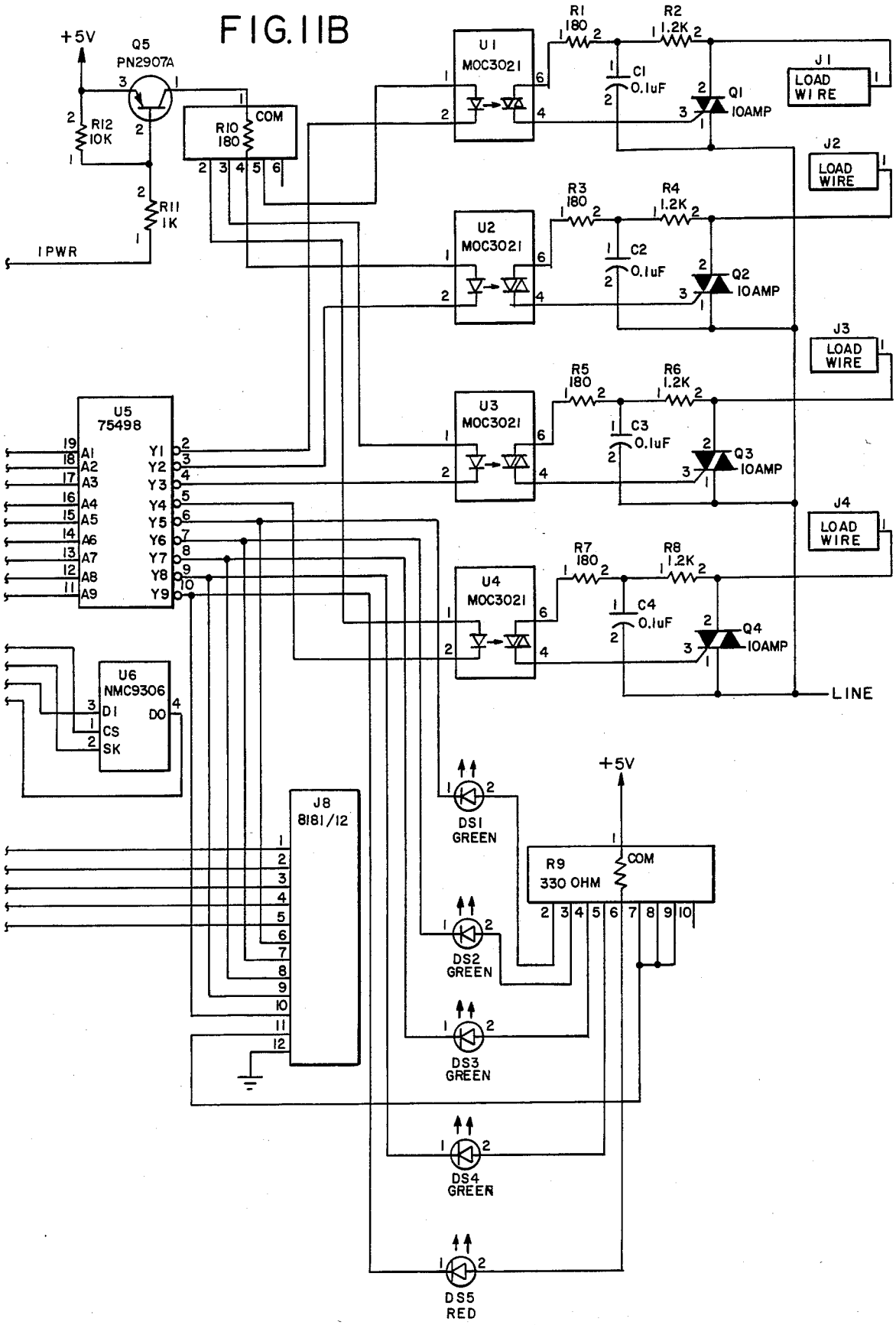

FIGS. 11*a* and 11*b* show a complete schematic diagram together with part numbers and component values which may be used to construct the preferred embodiment of the invention. This diagram is an expanded and more detailed version of FIG. 2.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A programmable circuit controller connected to a source of AC power for controlling a plurality of AC lighting circuits, comprising:

(a) level adjustment switch means for controlling the levels of AC power provided to each of said AC lighting circuits, respectively;

(b) learn switch means for storing signals representing power levels established by said level adjustment switch means in a memory;

(c) preset switch means for designating a plurality of power levels established by said level adjustment switch means to be stored in a memory as a predetermined set when said preset switch means is actuated simultaneously with the actuation of said learn switch means; and (d) wherein said preset switch means comprises a plurality of switches, each switch representing one predetermined set of lighting levels to be recalled from said memory and established as current lighting levels when one of said switches is actuated independently of said learn switch means.

2. The programmable circuit controller of claim 1 further including automatic fade control means for fading from one lighting level to a next lighting level.

3. The programmable circuit controller of claim 1, further including microprocessor means for periodically interrogating the states of said level adjustment switch means, said learn switch means, and said preset switch means, and for initiating AC lighting circuit control functions based upon the said states of said switches.

4. The programmable circuit controller of claim 3 wherein said microprocessor means includes a timer responsive to an AC power input waveform for periodically causing said microprocessor to compare the instantaneous phase angle of said waveform to a signal stored in a memory for each of said AC lighting circuits, and for turning on each respective one of said AC lighting circuits when said signal corresponds to said phase angle.

5. The programmable circuit controller of claim 4 wherein said microprocessor means senses the zero crossing of said AC power waveform and includes a program for sensing the input states of said level adjustment switch means, said learn switch means, and said preset switch means, said program being operative during a period of time immediately preceding to immediately following said zero crossing.

6. A programmable circuit controller connected to a source of AC power for controlling a plurality of AC lighting circuits comprising:

(a) a control panel including a plurality of input switches; and (b) a microprocessor responsive to a predetermined combination of signals from certain ones of said input switches for designating one or more of said AC lighting circuits as fluorescent lighting circuits, and for designating one other of said AC lighting circuits as a heating circuit, and storing said designations in a memory, such that whenever at least one of said fluorescent lighting circuits is turned on, said heater circuit is automatically turned on at full power.

7. The programmable circuit controller of claim 6 wherein said control panel includes a plurality of preset switches for establishing preset lighting levels for each of said AC lighting circuits.

8. The programmable circuit controller of claim 7 wherein said control panel further includes a plurality of level adjustment switches for establishing the levels of light intensity in each of said AC lighting circuits.

9. The programmable circuit controller of claim 7, further including an off switch for providing one of said signals in said predetermined combination of signals when said off switch is actuated simultaneously with one of said preset switches.

* * * * *